US006919572B2

(12) United States Patent
Loda

(10) Patent No.: US 6,919,572 B2
(45) Date of Patent: Jul. 19, 2005

(54) COMPENSATING FOR VARIATIONS IN ARTICLE SPEEDS AND CHARACTERISTICS AT DIFFERENT ARTICLE POSITIONS DURING ARTICLE IRRADIATION

(75) Inventor: Gary K. Loda, Pleasanton, CA (US)

(73) Assignee: The Titan Corporation, San Diego, CA (US)

( * ) Notice: Subject to any disclaimer, the term of this patent is extended or adjusted under 35 U.S.C. 154(b) by 0 days.

(21) Appl. No.: 10/428,504

(22) Filed: May 2, 2003

(65) Prior Publication Data

US 2004/0217300 A1 Nov. 4, 2004

(51) Int. Cl.[7] ..... A61N 5/00; H05G 3/00

(52) U.S. Cl. ..... 250/492.1; 250/492.3; 250/341.1

(58) Field of Search ..... 250/492.1, 492.3, 250/341.1, 341.6

(56) References Cited

U.S. PATENT DOCUMENTS 3,755,672 A * 8/1973 Edholm et al. ..... 378/158
5,396,074 A * 3/1995 Peck et al. ..... 250/453.11
6,215,847 B1 * 4/2001 Perrins et al. ..... 378/69
6,583,423 B2 * 6/2003 Rose ..... 250/453.11
6,690,020 B2 * 2/2004 Loda ..... 250/455.11
6,713,773 B1 * 3/2004 Lyons et al. ..... 250/492.3
6,777,689 B2 * 8/2004 Nelson ..... 250/455.11
2003/0021722 A1 * 1/2003 Allen et al. ..... 422/22
2004/0109532 A1 * 6/2004 Ford et al. ..... 378/57
2004/0217301 A1 * 11/2004 Loda ..... 250/492.1

FOREIGN PATENT DOCUMENTS

WO WO 01/25754 * 4/2001 ..... 250/454.11

* cited by examiner

*Primary Examiner*—Nikita Wells
*Assistant Examiner*—Anthony Quash
(74) *Attorney, Agent, or Firm*—Peter K. Hahn; David E. Heisey; Luce, Forward, Hamilton & Scripps

(57) ABSTRACT

First embodiment: an article is conveyed in a first direction at different speeds at different positions on the article in a second direction substantially perpendicular to the first direction. For example, when the article is conveyed in a rotary direction, the positions on the radially outer side of the article rotate at higher speeds than the positions at the radially inner side of the article. Radiant energy directed against the conveyed article is scanned on a cyclic basis in the second direction between the radially inner and outer sides of the article. During the scanning, the intensity of the radiant energy is varied at each position in the second direction to direct a constant intensity of radiant energy against the article at every position in the article. Second embodiment: the article scanning in the second direction is varied according to the article characteristics (e.g. thickness) in the second direction.

5 Claims, 7 Drawing Sheets

COMPENSATING FOR VARIATIONS IN ARTICLE SPEEDS AND CHARACTERISTICS AT DIFFERENT ARTICLE POSITIONS DURING ARTICLE IRRADIATION

This invention relates to systems for, and methods of, irradiating products including food products to make them safe to use or eat. More particularly, the invention relates in a first embodiment to electronic systems for, and methods of, compensating for differences in the intensity of the radiation applied to an article as a result of differences in the speed of the article past an accelerator at different positions in the article. In a second embodiment, the invention relates to electronic systems for, and methods of, compensating for differences in the article characteristics (e.g. thickness) in a direction substantially perpendicular to the directions in which radiation is applied to the article and in which the article is conveyed past the radiation from the beam.

BACKGROUND OF A PREFERRED EMBODIMENT OF THE INVENTION

It has been known for some time that drugs and medical instruments and implements have to be irradiated so that they will not cause patients to become ill from harmful bacteria when they are applied to the patients. Systems have accordingly been provided for irradiating drugs and medical instruments and implements. The drugs and the medical instruments and implements have then been stored in sterilized packages until they have been ready to be used.

In recent years, it has been discovered that foods can carry harmful bacteria if they are not processed properly or, even if they are processed properly, that the foods can harbor and foster the proliferation of such harmful bacteria if they are not stored properly or retained under proper environmental conditions such as temperature. Some of the harmful bacteria can even be deadly.

For example, harmful bacteria have been discovered in recent years in hamburgers prepared by one of the large hamburger chains. Such harmful bacteria have caused a number of purchasers of hamburgers at stores in the chain to become sick. As a result of this incident and several other similar incidents, it is now recommended that hamburgers should be cooked to a well done, or at least a medium, state rather than a medium rare or rare state. Similarly, harmful bacteria have been found to exist in many chickens that are sold to the public. As a result of a number of incidents which have recently occurred, it is now recommended that all chickens should be cooked until no blood is visible in the cooked chickens.

To prevent incidents such as discussed in the previous paragraphs from occurring, various industries have now started to irradiate foods before the foods are sold to the public. This is true, for example, of hamburgers and chickens. It is also true of fruits, particularly fruits which are imported into the United States from foreign countries.

In previous years, gamma rays have generally been the preferred medium for irradiating various articles. The gamma rays have been obtained from a suitable material such as cobalt and have been directed to the articles to be irradiated. The use of gamma rays has had certain disadvantages. One disadvantage is that irradiation by gamma rays is slow. Another disadvantage is that irradiation by gamma rays is not precise. This results in part from the fact that the strength of the source (e.g. cobalt) of the gamma rays decreases over a period of time. It also results in part from the fact that the gamma rays cannot be directed in a sharp beam to the articles to be irradiated. This prevents all of the gamma rays from being useful in irradiating the articles.

In recent years, electron beams have been directed to articles to irradiate the articles. Electron beams have certain advantages over the use of gamma rays to irradiate articles. One advantage is that irradiation by electron beams is fast. For example, a hamburger patty having a square cross section can be instantaneously irradiated by a passage of an electron beam of a particular intensity through the hamburger patty. Another advantage is that irradiation by an electron beam is relatively precise because the strength of the electron beam remains substantially constant even when the electron beam continues to be generated over a long period of time.

X-rays have also been used to irradiate articles. The x-rays may be formed from electron beams. An advantage in irradiating articles with x-rays is that the articles can be relatively thick. For example, x-rays can irradiate articles which are thicker than the articles which are irradiated by electron beams. A disadvantage is that the x-rays cannot be focused in a sharply defined beam.

The systems now in use are relatively complicated and relatively expensive and occupy a considerable amount of space. These systems are particularly effective when used at companies requiring radiation of large volumes of products at a particular location. These companies are generally large and have considerable assets. No system apparently exists for irradiating reduced volumes of products at a particular location. No system also apparently exists for use by companies of small or medium size.

Co-pending application Ser. No. 09/971,986, filed on Oct. 4, 2001 by Gary K. Loda for a Compact Self-Shielded Irradiation System and Method and assigned of record to the assignee of record of this application discloses and claims a system for, and method of, providing a simplified system operative in a minimal space, and having a minimal cost, for irradiating products without any significant sacrifice in the quality of the radiation of the products compared to the irradiation provided in the prior art. The invention disclosed and claimed in co-pending application Ser. No. 09/971,986 is particularly effective for use by companies of small or medium size or where the irradiation of products is only sporadic.

An accelerator in the system disclosed and claimed in co-pending application Ser. No. 09/971,986 provides radiant energy in a first direction. A carousel and first and second members have a common axis in the first direction. The carousel, preferably having a hollow cylindrical configuration, has a ring-shaped configuration defined by inner and outer diameters. The first member has an outer diameter preferably contiguous to the inner diameter of the carousel.

The second member has an inner diameter preferably contiguous to the outer diameter of the carousel. The first and second members provide shielding against the radiant energy from the accelerator.

A single motor (e.g., a stepping member) rotates the carousel past the radiant energy in co-pending application Ser. No. 09/971,986 continuously at a substantially constant speed in successive revolutions. Vanes made from a shielding material are disposed at spaced positions in the carousel to divide the carousel into compartments for receiving the articles and to isolate each compartment against the radiant energy in other compartments.

A loader in co-pending application Ser. No. 09/971,986 loads the articles into compartments before the movement of the articles in the compartments past the radiant energy. An unloader in co-pending application Ser. No. 09/971,986 unloads the articles from the compartments after the movement of the articles in the compartments past the radiant energy.

Another system exists in the prior art for irradiating articles. The system includes a conveyor movable in a first direction past an article which receives radiation in a second direction substantially perpendicular to the first direction. The article has variable characteristics in a third direction substantially perpendicular to the first and second directions. A system has been disclosed in co-pending application Ser. No. 09/912,576 filed on Jul. 24, 2001 by John Thomas Allen, George M. Sullivan and Colin Brian Williams for Fixtures For Providing An Irradiation Within Acceptable Limits and assigned of record to the assignee of record of this application. Co-pending application Ser. No. 09/912,576 discloses a non-electronic system for, and method of, compensating for differences in the characteristics of the article in the third direction to obtain a substantially constant irradiation at the different positions in the article regardless of the differences in the characteristics of the article in the third direction.

BRIEF DESCRIPTION OF A PREFERRED EMBODIMENT OF THE INVENTION

In a first embodiment, an article is conveyed in a first direction at different speeds at different positions in the article in a second direction perpendicular to the first direction. For example, when the article is conveyed in a rotary direction, the positions on the radially outer side of the article rotate at higher speeds than the positions at the radially inner side of the article. Such a system is disclosed and claimed in co-pending application Ser. No. 09/971,986.

Radiant energy directed against the conveyed article is scanned in a second direction substantially perpendicular to the first direction. During the scanning, the intensity of the radiant energy is varied at each position in the second direction to direct a constant intensity of radiant energy against the article at every position in the article.

In a second embodiment, the article scanning in the second direction is varied according to the article characteristics (e.g. thickness) in the second direction.

DETAILED DESCRIPTION OF A PREFERRED EMBODIMENT OF THE INVENTION

Figure 1:
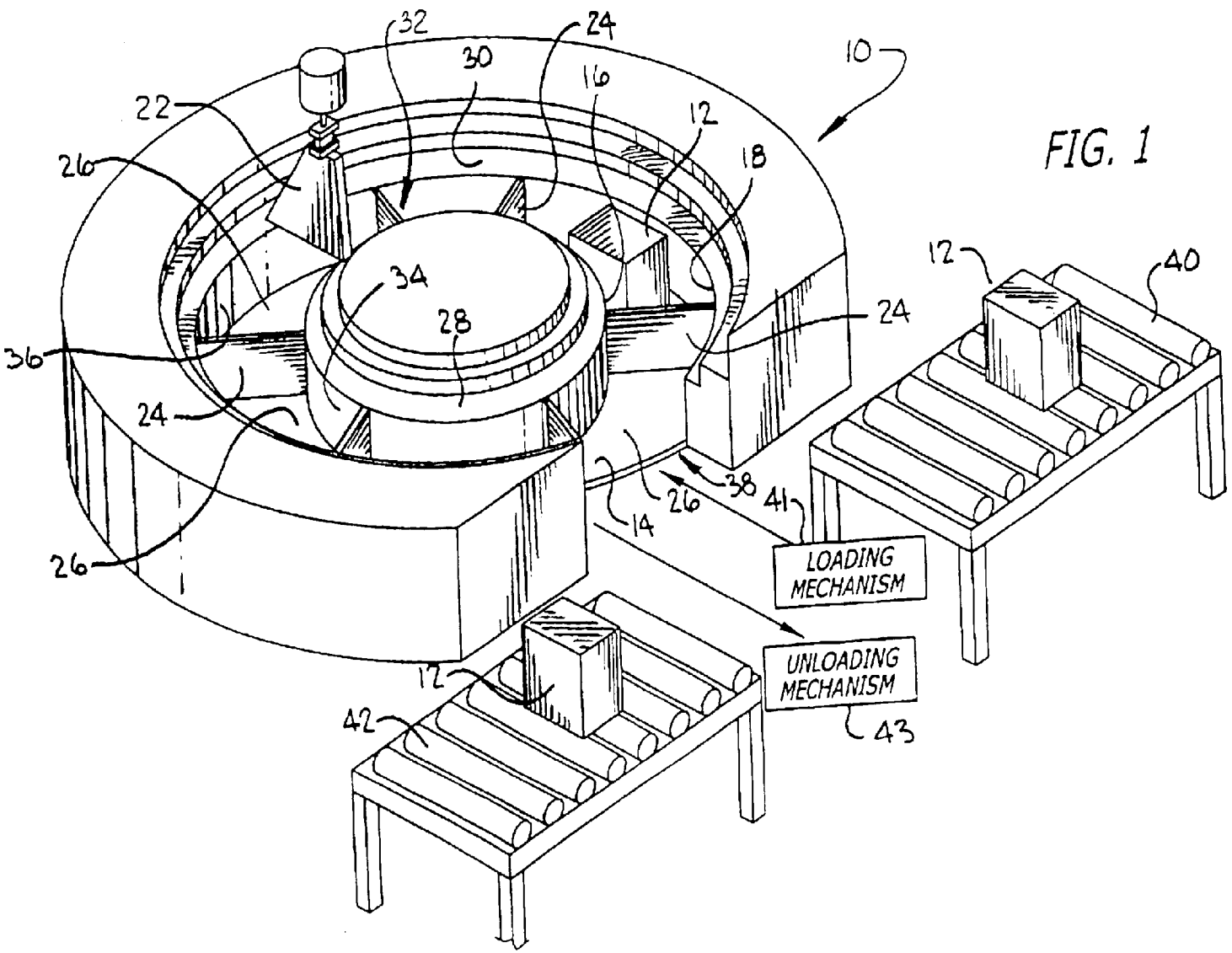
FIG. 1 is a perspective view, as seen from a position above the apparatus, of a preferred embodiment of a system disclosed and claimed in co-pending application Ser. No. 09/971,986 for irradiating articles, the preferred embodiment including a rotary carousel, compartments in the carousel and articles in the compartments.
Figure 3:
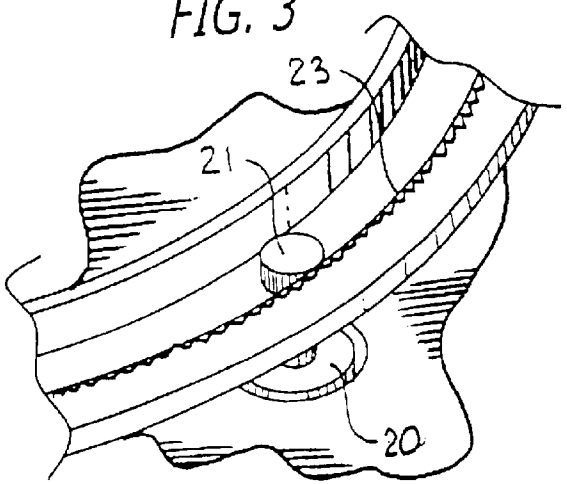
FIG. 3 is a fragmentary perspective view of the carousel shown in FIGS. 1 and 2 and of a stepping motor arrangement for rotating the carousel at a substantially constant speed.
Figure 2:
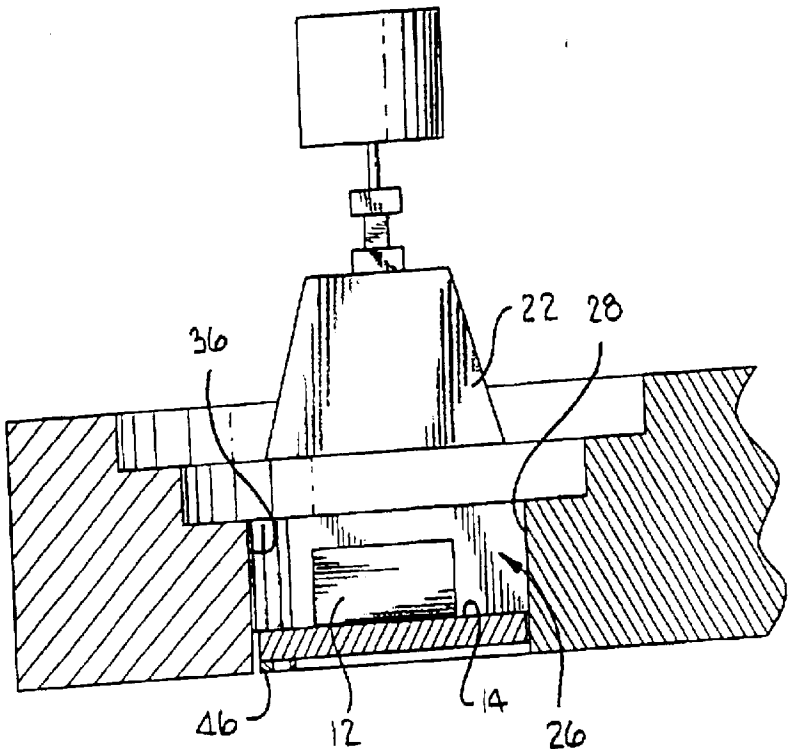
FIG. 2 is a fragmentary sectional view of the carousel, the compartments and the articles shown in FIG. 1 and of an accelerator for irradiating the articles in the compartments.
Figure 4:
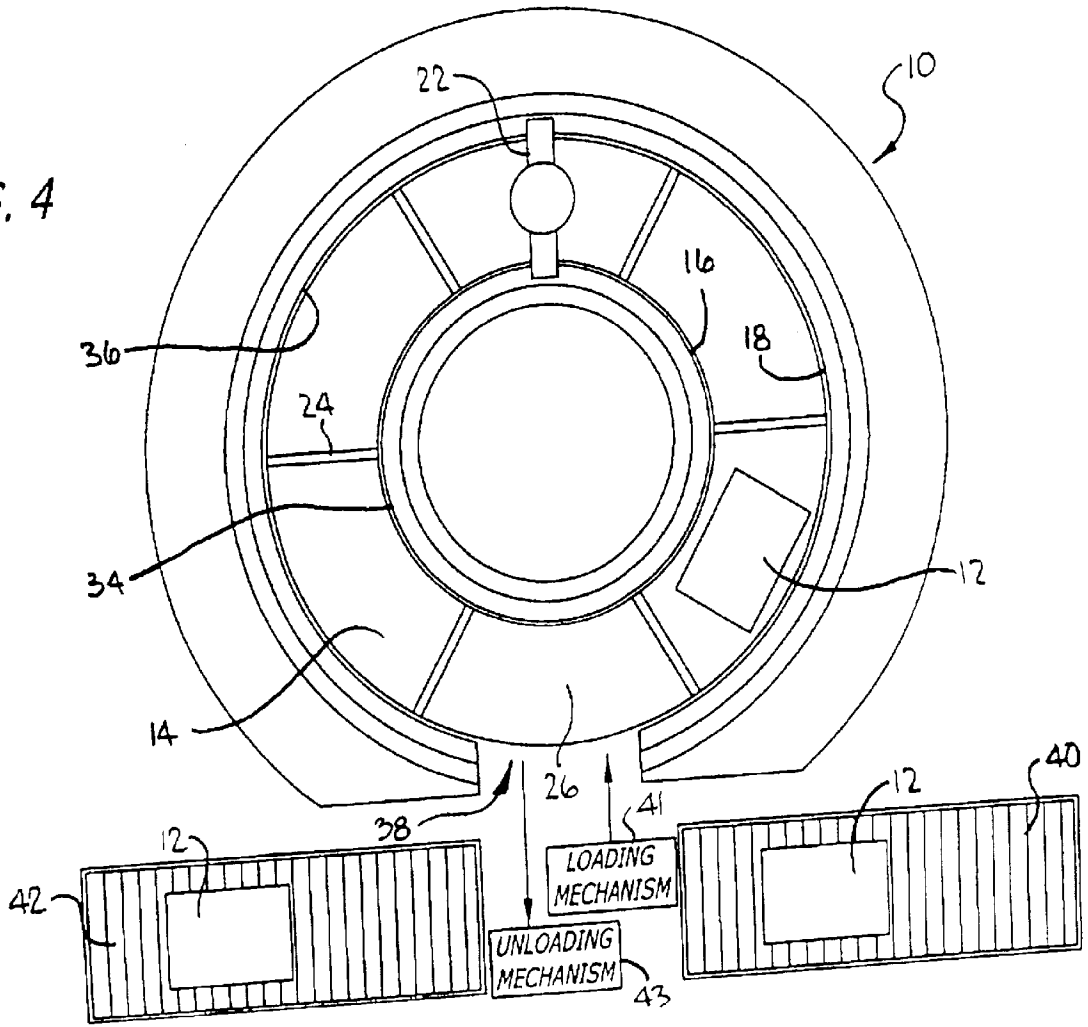
FIG. 4 is a top plan view of the embodiment shown in FIGS. 1–3 for irradiating articles of the invention for irradiating articles.

A system shown in FIGS. 1–4 and generally indicated at 10 and disclosed and claimed in co-pending application Ser. No. 09/971,986 may be considered to constitute prior art. The system is provided for irradiating articles 12. The radiation may be provided by gamma rays, electron beams or x-rays, although electron beams are generally preferred. The articles 12 may be drugs, medical instruments and medical products which are irradiated so that they will not cause patients to become ill from harmful bacteria when they are applied to the patients. The articles 12 may also be different food articles such as meat, poultry, vegetables and fruit, particularly those imported from foreign countries.

The system 10 includes a carousel 14. The carousel 14 has a ring shape, preferably cylindrical, defined by an axis of rotation and by an inner diameter 16 and an outer diameter 18. The inner and outer diameters 16 and 18 of the carousel 14 are coaxial with the carousel axis of rotation. The carousel is rotatable as by a motor 20, preferably at a substantially constant speed. The motor 20 may be a stepping motor which drives a pinion gear 21 along a rack gear 23 provided in the carousel 14. The rotary movement of the carousel 14 is past radiation from a source or accelerator 22. The radiation from the source or accelerator 22 is in a direction corresponding to the axis of rotation of the carousel 14.

In the system disclosed and claimed in co-pending application Ser. No. 09/971,986, vanes 24 are disposed in the carousel 14, preferably at spaced intervals in the annular direction around the carousel. The vanes 24 divide the carousel 14 into compartments 26 for receiving the articles 12. The vanes 24 may be made from a suitable material such as a steel or other metal having properties of providing radiation shielding to prevent radiation in one compartment from entering into other compartments. The vanes 24 extend within the carousel 14 preferably between the inner diameter 16 and the outer diameter 18 of the carousel. The vanes 20 particularly provide shielding in each compartment 26 against x-rays.

A radiation shielding member 28 is disposed within the inner diameter 16 of the carousel 14. The shielding member 28 is stationary and preferably cylindrical and is provided with the same axis as the carousel 14. The radiation shielding member 28 is preferably made from a suitable material such as concrete. A radiation shielding member 30 is provided with a hole 32, preferably cylindrical and preferably having an axis corresponding to the axis of rotation of the carousel 14. Preferably the shielding member 30 is contiguous to the outer diameter 18 of the carousel 14. The shielding member 30 may be made from a suitable material such as steel or any suitable metal or from concrete or from a combination of steel and concrete.

Walls 34 and 36 in the system disclosed and claimed in co-pending application Ser. No. 09/971,986 define an opening 38 in the shielding member 30. Preferably the walls 34 and 36 are separated from each other to provide the opening 38 with an angle of approximately 45 degrees. A loading area 40 is provided adjacent the wall 34 to provide for the loading of the articles 12 on the carousel 14. Mechanisms 41 well known in the art may be provided for loading the articles 12 into the compartments 26 from the loading area 40. An unloading area 42 is provided adjacent the wall 36 to provide for the unloading of the articles 12 from the carousel 14 after the articles have been irradiated by the source or accelerator 22. Mechanisms 43 well known in the art may be provided for unloading the articles 12 from the compartments 26 into the unloading area 42.

The articles 12 are loaded into the compartments 26 at the loading area 40 while the carousel 14 is moved at a substantially constant speed by the stepping member 20. The articles 12 then move at the substantially constant speed past the radiation from the source or accelerator 22. This causes progressive positions in the articles 12 in the direction of movement of the carousel 10 to be irradiated with a substantially constant dosage of radiation. After being irradiated, the articles 12 move at the substantially constant speed to the unloading area 42 where the articles are unloaded from the carousel 14.

The articles 12 may have irregular shapes. This causes the radiation dosage at progressive positions in the articles 12 to vary dependent upon the thickness of the articles at these positions. Application Ser. No. 09/912,576 assigned of record to the assignee of record of this application discloses a system for providing fixtures complementary to the irregular configuration of the articles at the progressive positions. These fixtures cause the radiation dosage of the articles at progressive positions in the articles to be substantially constant, within acceptable limits, even with irregularities in the configuration of the articles at the progressive positions.

The system 10 disclosed above and also disclosed and claimed in co-pending application Ser. No. 09/971,986 irradiates the articles 12 from only one side of the articles. If it is desired to irradiate the articles 12 from two (2) opposite sides of the articles, the articles may be rotated through an angle of 180 degrees to expose the second side of the articles to radiation from the source or accelerator 22. Alternatively, a second source or accelerator may be disposed on the opposite side of the articles from the source or accelerator 22 to irradiate the second side of the articles. These arrangements are well known in the art.

The system and method described above and disclosed and claimed in co-pending application Ser. No. 09/971,986 have certain important advantages over the prior art. For example, the manufacturing cost and the floor space required by the system is considerably less than is presently being provided. This difference may be by as much as a factor of four (4). Furthermore, the system and method disclosed and claimed in co-pending application Ser. No. 09/971,986 extend the market to customers who cannot afford the systems now being offered in the market. Novel and patentable features of this invention include the closed loop ring-shaped carousel, the single motor for driving the carousel at a substantially constant speed, the radiation shielding within the carousel and outside of the carousel and the vanes for dividing the carousel into compartments and for shielding the articles in the compartments against extraneous radiation, particularly x-rays.

Figure 5:
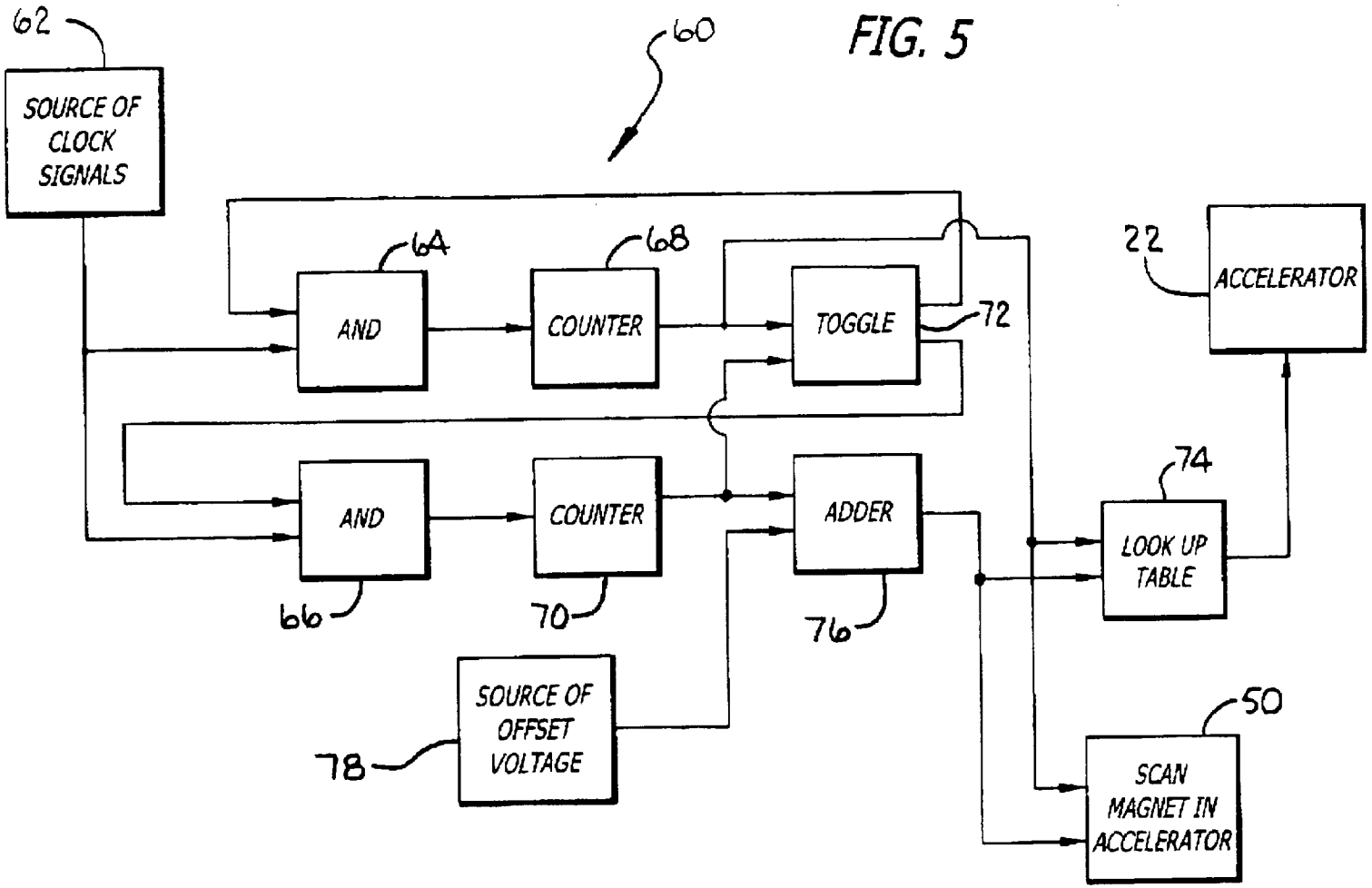
FIG. 5 is a block diagram of an electrical system for compensating for differences in the intensity of the radiant energy applied to the article at different radial positions in the article, these differences resulting from higher speeds of movement of the articles at the radially outer end of the articles than at the radially inner end of the articles.
Figure 8:
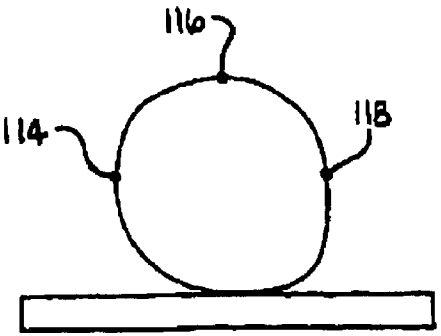
FIG. 8 is a schematic sectional view in elevation of an article (e.g. a chub) having a cylindrical configuration and shows a section of the article in a scan direction.

The accelerator 22 is standard and is well known in the art. It provides a beam of electrons which flow downwardly in FIG. 1. It includes a scan magnet 50 which is shown in FIG. 5 and which provides for a scan of the beam in a direction extending into and out of the plane of the paper as the carousel 14 rotates in a direction 50 in FIG. 1. This scan is shown at 52 in FIG. 5 as being to the left and right in that Figure. This scan is provided by applying a cyclic voltage progressively increasing to a particular magnitude in a sawtooth waveform, then decreasing instantaneously to zero and then progressively increasing in the sawtooth waveform to the particular magnitude. The scan magnet 50 bends the electron beam in the plane of the paper in FIG. 8 at each instant through an angle dependent upon the magnitude of the voltage applied to the scan magnet at that instant. The accelerator 22 also includes a bar magnet 154 (FIGS. 9 and 10) which adjusts the angle of the electron beam so that the electron beam extends vertically downward in FIG. 1.

The rotational speed of the carousel 14 may be sensed at each instant and the speed may be adjusted in a servo loop so that the speed remains substantially constant. Furthermore, the magnitude of the voltage applied to the scan magnet 50 increases linearly in each cycle at a substantially constant rate. In this way, the position at each instant of the radiant energy beam in the scan direction may be precisely determined.

As will be seen in FIGS. 1–4, the carousel 14 rotates faster at the radial outer end of the carousel than at the radial inner end of the carousel. Specifically, the speed of the carousel at a radial position 26 is greater than the speed of the carousel at a radial position 28. Thus, if the carousel receives the same intensity of the radiation at every position in the carousel, the intensity of the radiant energy at the position 26 will be less than the radiant energy at the position 28. This is undesirable since the article 12 should receive the same intensity of radiation at each position in the article in the scan direction.

FIG. 5 is a block diagram of a preferred embodiment, generally indicated at 60, for producing a substantially constant intensity of radiant energy at every position in the carousel 14. The embodiment shown in FIG. 5 includes a source 62 of clock signals. The source 62 is connected to input terminals of a pair of AND networks 64 and 66. The signals passing through the AND networks 64 and 66 are respectively introduced to a pair of counters 68 and 70. The outputs from the counters 68 and 70 pass to input terminals of a toggle 72. The two (2) outputs from the toggle 72 respectively pass to second input terminals of the AND networks 64 and 66.

The output from the counter 68 passes to an input terminal of a look-up table 74. The output from the look-up table 74 is introduced to the accelerator 22. The output from the counter 70 is also introduced to the scan magnet 50 in the accelerator 22. The scan magnet 50 in the accelerator 22 also receives the output of an adder 76, the output of the adder also being introduced to a second input terminal in the look-up table 74. Input terminals of the adder 74 are respectively connected to the output terminal of the counter 70 and to a source 78 of an offset voltage.

The counters 68 and 70 count the clock signals from the source 62 and produce at each instant a voltage proportional to the count at that instant. However, only one of the counters 68 and 70 is activated at any time. Assume that the counter 68 is initially activated. The voltage from the counter 68 is accordingly introduced to the scan magnet 50 which produces a scan of the radiant energy beam from the accelerator 22 in a scan direction transverse, preferably perpendicular, to the direction of movement of the carousel 14 and the direction of the beam of radiation from the accelerator. The positioning of the radiant energy beam in the scan direction at each instant is dependent upon the voltage from the counter 68 at that instant.

When the count in the counter 68 reaches a particular value corresponding substantially to the width of the article 12, it causes the toggle 72 to be activated. A signal then passes from the toggle 72 to an input terminal of the AND network 64 to close the AND network against the passage of the signals. At the same time, an internal connection in the counter 68 causes the counter to be reset to a value of zero (0) so that the counter is ready to initiate a new count to the particular value.

At the same time that the toggle 72 closes the AND network 64 against the passage of clock signals through the AND network, the toggle 72 opens the AND network 66 to pass the clock signals to the counter 70. The counter 70 then counts the clock signals from the source 62 to the particular value. The toggle 72 then closes the AND network 66 and opens the AND network 64. In this way, the counter 68 counts to the particular value in alternate cycles and the counter 70 counts to the particular value in the other cycles.

During the alternate cycles in which the counter 68 is activated, the voltage from the counter is introduced to the scan magnet 50 to obtain a scan of the radiant energy beam in a direction corresponding to the width of the articles 12. At the same time, the voltage from the counter 68 is introduced to the look-up table 74. The look-up table 74 provides voltages which are introduced to the accelerator 22 to produce radiant energy with an intensity for compensating for the differences in the speed of movement of the carousel 14 in the annular direction. In other words, the look-up table 74 produces a higher voltage when the scan is at the radially outer end of the carousel 14 than when the scan is at the radially inner end of the carousel. Specifically, the voltage from the look-up table 74 increases with progressive positionings of the radiant energy beam from a radially interior position to a radially exterior position. In this way, the intensity of the radiant energy applied at each position in the article 12 in the scan direction is regulated so as to be substantially constant at each position in the article.

In the alternate scan cycles in which the counter 70 is activated, the voltage from the counter 70 is introduced at each instant to the adder 70. The adder 70 also receive an offset voltage from the source 78. The adder 76 adds at each instant the offset voltage to the voltage from the counter 70. The resultant voltage from the adder 70 is offset from the voltage from the counter 68 in the alternate cycles in which the counter 68 is activated.

Figure 6:
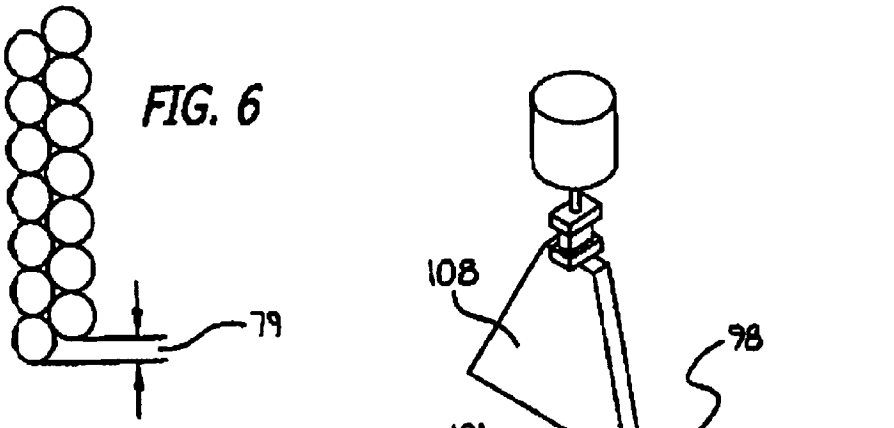
FIG. 6 shows the positions of successive pixels in the articles in the scan direction in two (2) successive scans of the radiant energy beam in the scan direction.

The offset relationship between the voltage from the counter 70 and the voltage from the adder 76 in alternate scan cycles is illustrated at 79 in FIG. 6. As will be appreciated and as will be seen in FIG. 6, the counters 68 and 70 produce pixels which have a substantially circular configuration. If the offset is not provided in the scan by the counter 70 in the alternate scan cycles, voids would be produced in the successive scans because of the spaces between the substantially round pixels. These voids could affect the intensity of the radiant energy at the position of the void so that the intensity of the irradiation would not be substantially constant at every position in the article. These voids are eliminated by adding the offset from the source 78 to the voltage from the counter 70 in the alternate scans in which the counter 70 is activated. The elimination of the voids is shown schematically in FIG. 6.

The embodiment shown in FIGS. 5 and 6 and described above provides a system in which a compensation is made, during each cycle of scan in a direction substantially perpendicular to the direction of movement of the conveyor and the direction of the radiant energy beam, for differences in the speed of movement of the articles at different positions in the scan direction.

The system shown in FIGS. 5 and 6 and described above may be also used to compensate for differences in the characteristics (e.g. thicknesses) of the articles 12 in the scan direction when the articles are being conveyed at a substantially constant speed at the different positions in the scan direction. This system is shown schematically in FIG. 7 and is generally indicated at 98 in FIG. 7.

Figure 7:
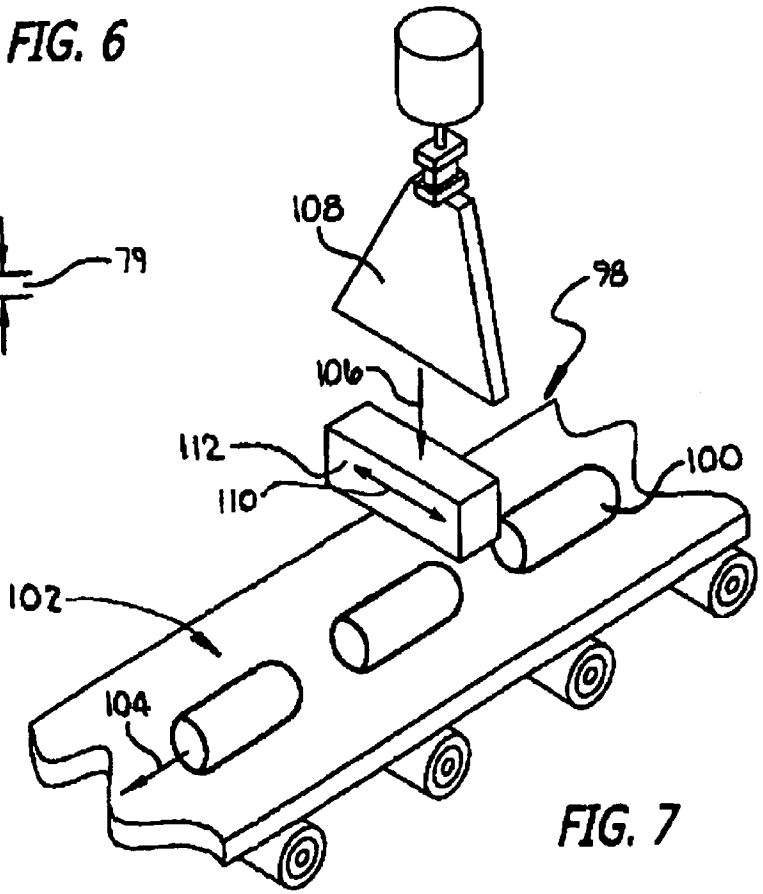
FIG. 7 is a perspective view of a conveyor system of the prior art for conveying articles past a beam of radiant energy at a substantially constant speed at different positions in the article.

In the system 98 in FIG. 7, an article 100 is conveyed by a conveyor, generally indicated at 102, in a first direction 104 past a radiant energy beam 106 from an accelerator 108. The beam 106 is in a second direction substantially perpendicular to the first direction 104. The speed of movement of the article 100 may be substantially constant in the first direction 104 at every position in the article. The article 100 may constitute a chub which illustratively may have a substantially cylindrical configuration in a scan direction 110 substantially perpendicular to the first direction 104 and substantially perpendicular to the direction 106 of the beam 106 of radiant energy from the accelerator 108. A scan magnet 112 scans the beam of radiant energy at a substantially constant speed in the scan direction 110 on a cyclic basis. The system 100 as described above is well known in the prior art.

Since the article 100 constitutes a chub having a cylindrical configuration, the thickness of the article at each position in the scan direction 110 will be different from the thickness of the article at adjacent positions in the scan direction. If every position in the article 100 in the scan direction 110 received the same intensity of radiant energy regardless of the thickness of the article at that position, the intensity of the irradiation applied to the article at the different positions in the article would vary considerably at different positions in the scan direction 110.

The system 60 shown in FIGS. 5 and 6 compensates for the difference in the thickness of the article 100 at the different positions in the scan direction 110 by providing the proper values in the look-up table 74. For example, when the article 100 constitutes a chub which has a cylindrical configuration in the scan direction 110, the values in the look-up table 74 for the successive digital positions in FIG. 6 in the scan direction 110 provide for progressive increases in the intensity of radiant energy from a position 114 to a position 116 in FIG. 8 because of an increasing thickness in the article 100 between these positions. The values in the look-up table 74 provide for progressive decreases in the intensity of the radiation from the position 116 to a position 118 in FIG. 8 because of a progressively decreasing thickness in the article 100 between these positions.

It will be appreciated that the values in the look-up table 74 may be adjusted to compensate for any variation in the configuration of the article 100 in the scan direction 110. It will also be appreciated that offsets such as shown in FIG. 6 may be provided in the system shown in FIGS. 5 and 7 to compensate for differences in the thickness of the articles 100 in the scan direction when the articles are conveyed by the system shown in FIG. 7.

Figures 9, 11:
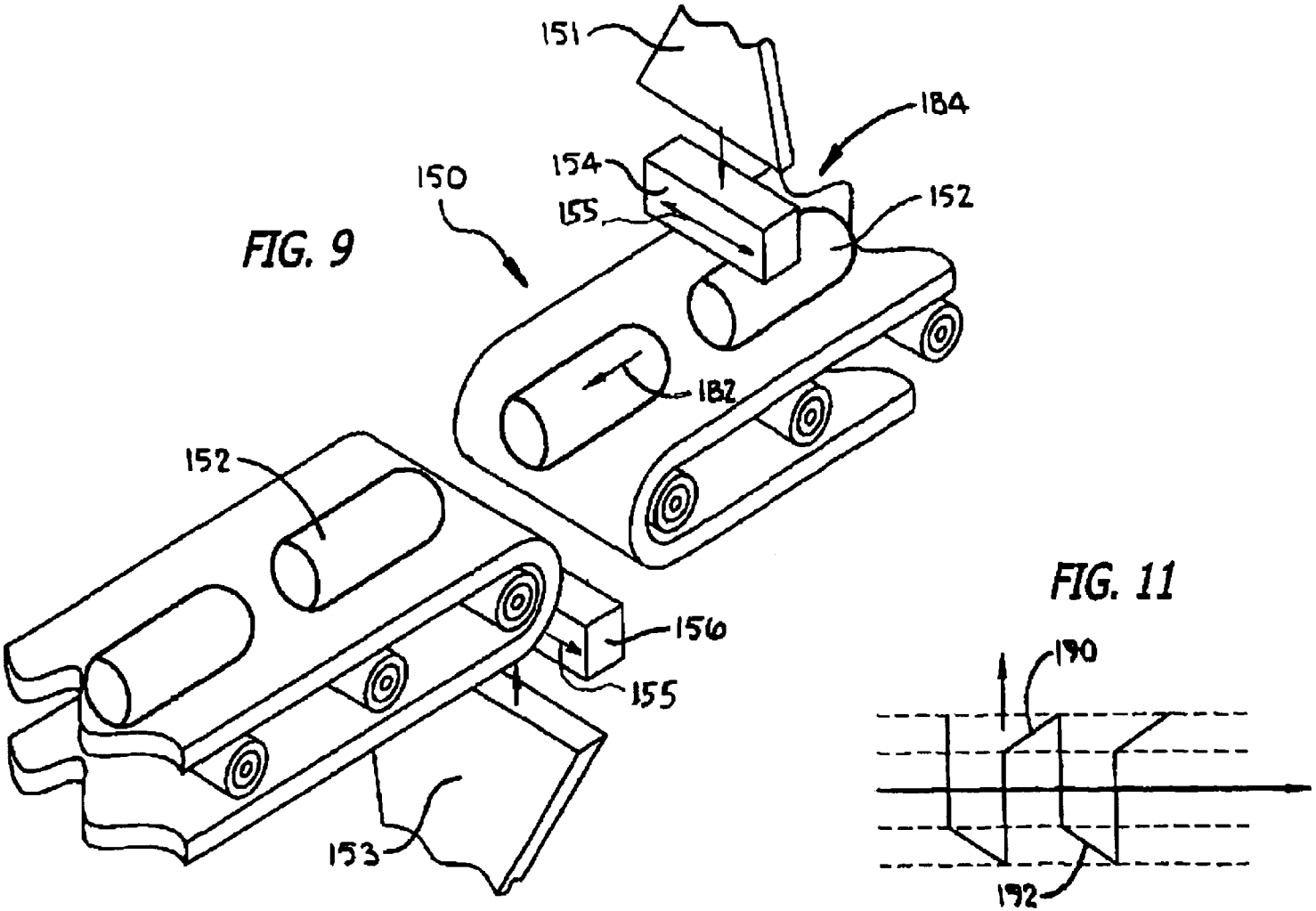
FIG. 9 is a schematic perspective view of a conveyor system which is similar to that shown in FIG. 7 but in which accelerators are provided on opposite sides of an article to irradiate the article from opposite sides of the article.
FIG. 11 indicates the wave form of a voltage generated by the system shown in FIG. 10 for irradiating the opposite sides of an article.

FIG. 9 is a view of a system, generally indicated at 150, similar to the system 98 in FIG. 7. However, the system 150 in FIG. 9 provides for an irradiation of an article 152 (e.g. a chub) from opposite sides of the article without inverting the position of the article. In this way, the system 150 can irradiate articles 152 having a greater thickness than the articles 100 in FIG. 7. The system 150 includes an accelerator 151 on a first side of the article 152 and an accelerator 153 on a second side of the article opposite to the first side of the article. The system 150 also includes a scan magnet 154 for scanning the article 152 in a scan direction 155 on a first side of the article and a scan magnet 156 for scanning the article in the scan direction 155 on a second side of the article opposite to the first side.

Figure 10:
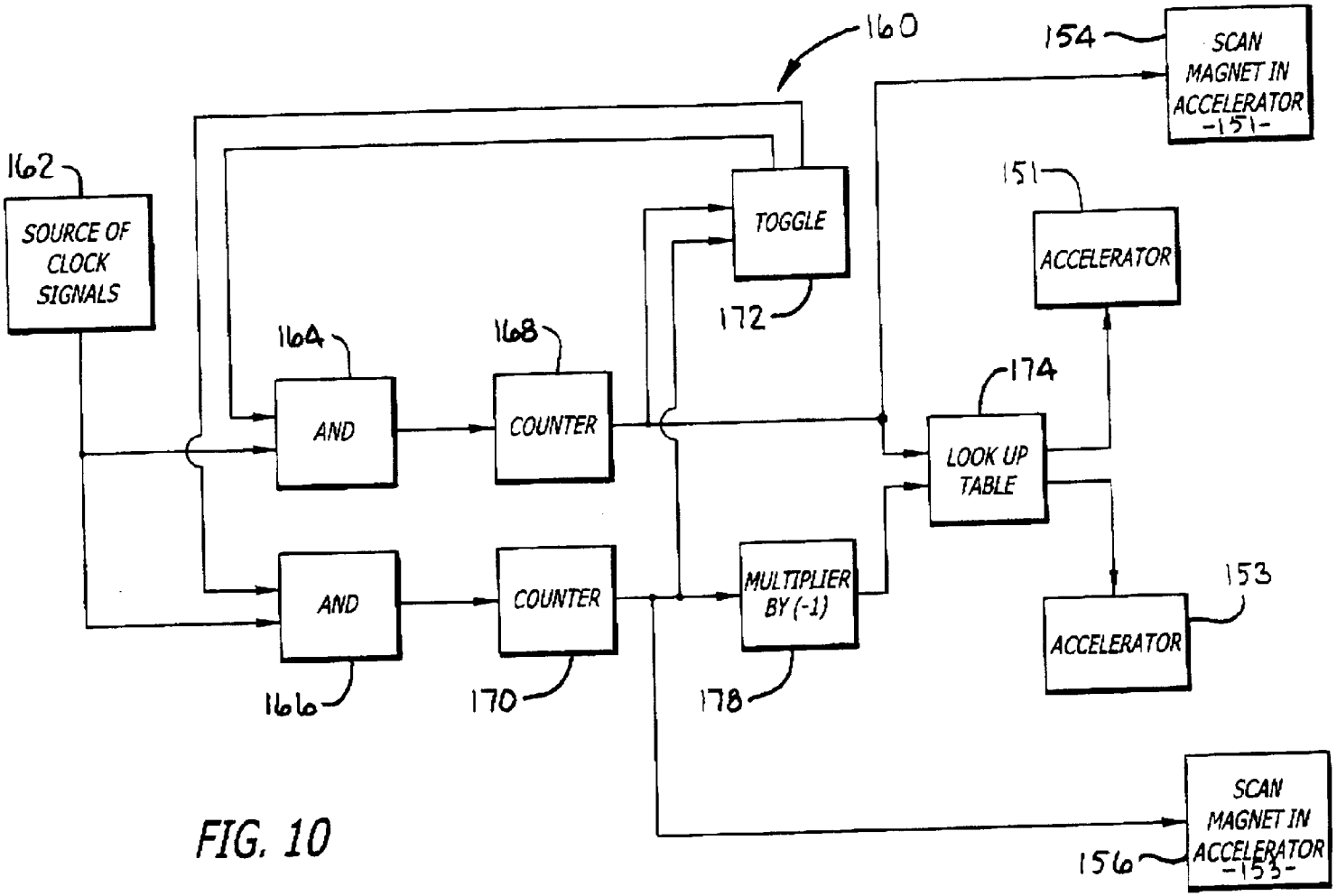
FIG. 10 is a block diagram of an electrical system for use with the system shown in FIG. 9 for scanning opposite sides of an article and for compensating for variations in the thickness of an article (e.g. a chub) in the scan direction by varying the intensity of the radiant energy at the different positions of the article in the scan direction.

FIG. 10 is a block diagram of an electrical system, generally indicated at 160, for providing scans by the scan magnets 154 and 156 on opposite sides of the article 152. The system 160 includes a source 162 of clock signals. The source 162 introduces the clock signals to first input terminals of a pair of AND networks 164 and 166. The outputs from the AND networks 164 and 166 respectively pass to the input terminals of a pair of counters 168 and 170. The output from the counter 168 is introduced to a first input terminal of a toggle 172, to a first input terminal of a look-up table 174 and to the scan magnet 154. A first output terminal of the toggle 172 is connected to a second input terminal of the AND network 164. A connection is made from a first output terminal of the look-up table 74 to the accelerator 151.

In like manner, the output from the counter 170 is introduced to a second input terminal of the toggle 172 and to the scan magnet 156. A second output terminal of the toggle 172 is connected to a second input terminal of the AND network 166. The output from the counter 170 is introduced to a multiplier 178 which converts the positive number from the counter 170 to a corresponding negative number. The output from the multiplier 178 passes to a second input terminal of the look-up table 174, a second output terminal of which is connected to the accelerator 153. The accelerator 153 is disposed on the opposite side of the article 152 from the accelerator 151. The accelerator 153 may be displaced from the accelerometer 151 in the direction 182 of movement of the article 152 by a conveyor generally indicated at 184 in FIG. 9.

The counters 168 and 170 count the clock signals from the source 162 to a particular value. Assume that the counter 168 is initially activated. When the counter 168 counts the clock signals from the source 162 to the particular value, the toggle 172 de-activates the counter 168 and activates the counter 170. The counter 170 then counts the clock signals from the source 162 to the particular value. The counter 170 then becomes de-activated and the counter 168 becomes activated. When the counter 168 is activated, the digital signals produced in the counter are converted to an analog voltage representative of the digital signals and this analog voltage is introduced to the scan magnet 154 to scan the article 152 in the scan direction 155 from a first side of the article.

The digital signals from the counter 168 are also introduced to the look-up table 174 which produces a voltage that is introduced to the accelerator 151. This voltage causes the accelerator 151 to provide at each instant in the scan direction 155 a radiant energy intensity which compensates for the thickness of the article 152 at that instant. For example, the operations of the scan magnet 154 and the accelerator 151 at each instant cause the intensity of the irradiation from the accelerator 153 to have an intensity pattern indicated at 190. This pattern is inverse to the pattern defined by the thickness of the article 152 at the progressive positions in the scan direction 155. This intensity pattern causes the intensity of the radiant energy in the article 152 in the scan direction 155 to be substantially constant even though the thickness of the article 152 is not uniform at the successive positions in the scan direction.

In like manner, when the counter 170 is activated, the digital signals produced in the counter are converted to an analog voltage representative of the digital signals. The analog voltage is introduced to the scan magnet 156 to scan the article 152 in the scan direction 155 from a second side of the article opposite to the first side. The digital signals from the counter 170 are also converted to a negative value by the multiplier 178. The signals from the multiplier 178 are introduced to the lookup table 174 which produces a voltage that is introduced to the accelerator 153. This voltage causes the accelerator 153 to provide at each instant a radiant energy intensity which compensates for the thickness of the article 152 in the scan direction 155 at that instant. For example, the operations of the scan magnet 156 and the accelerator 153 at each instant cause the intensity of the irradiation from the accelerator to have an intensity pattern indicated at 192. This pattern is inverse to the pattern defined by the thickness of the article 152 at the progressive positions in the scan direction 155. This intensity pattern causes the intensity of the radiant energy in the article 152 to be substantially constant at each position in the scan direction even though the thickness of the article 152 is not uniform at every position in the scan direction.

In this way, the conveyor shown in FIG. 9 and the electronic system 160 shown in FIG. 10 are able to irradiate articles of increased thickness with a substantially constant intensity at each position of the articles in the scan direction even though the thickness of the article is not uniform at the different positions in the scan direction. It will be appreciated that the electronic system 160 in FIG. 10 does not provide an offset. However, it is believed that a person of ordinary skill in the art will be able to provide an offset in the system 160 in FIG. 10 on the basis of the offset 79 shown in FIG. 6 and provided in the electronic system 60 shown in FIG. 5.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

What is claimed is:

1. A method of applying radiant energy to articles, including the steps of:

providing radiant energy in a first direction, conveying the articles past the radiant energy in a second direction transverse to the first direction, such that incremental positions of the articles in a third direction transverse to the first and second directions are conveyed at different speeds past the radiant energy, scanning the radiant energy on a cyclical basis in the third direction, varying the intensity of the radiant energy in the incremental positions of the articles in the third direction to compensate for the different speeds of the incremental positions of the articles in the second direction as the articles are conveyed past the radiant energy, and offsetting the scanning of the radiant energy in the third direction in alternate cycles relative to the scanning of the radiant energy in the third direction in the other cycles.

2. A method as set forth in claim 1 wherein the scanning of the radiant energy in the third direction is incremental and wherein the variation in the intensity of the radiant energy in the incremental positions of the articles in the third direction is incremental to compensate for the differences in the speed of conveyance of the articles in the second direction at the incremental positions of the articles in the third direction.

3. A method as set forth in claim 1 wherein the first, second and third directions are substantially perpendicular to one another and wherein the second direction is in a loop defined by a particular axis, thereby producing linear increases in the speed of movement of the article at progressive increases in the diameter of the loop and wherein the intensity of the radiation is linearly increased at linear increases in the radius of the loop.

4. A method as set forth in claim 1 wherein the conveyor is in the form of a cylindrical carousel having a ring-shaped configuration and wherein first radiation shielding material is disposed within the ring configuration and second radiation shielding material is disposed outside of the ring configuration.

5. A method as set forth in claim 1 wherein an offset is provided in alternate cycles in the scanning of the articles in the third direction and wherein compensation is provided, in the third direction in the alternate cycles, in the intensity of the radiant energy for the offset in the scanning of the articles.

* * * * *